United States Patent [19]

Stanley

[11] 4,173,167

[45] Nov. 6, 1979

[54] ORGAN STOP SWITCHING SYSTEM

[75] Inventor: Donald E. Stanley, Hillsboro, Oreg.

[73] Assignee: CBS, Inc., New York, N.Y.

[21] Appl. No.: 880,438

[22] Filed: Feb. 23, 1978

[51] Int. Cl.[2] ..... G10B 3/10

[52] U.S. Cl. ..... 84/345; 84/370

[58] Field of Search ..... 84/345, 370, 337, 1.03

[56] References Cited

U.S. PATENT DOCUMENTS

| | | | |
|---|---|---|---|
| 3,307,050 | 2/1967 | Castle | 307/112 |
| 3,341,819 | 9/1967 | Emerson | 340/172.5 |
| 3,497,714 | 2/1970 | Castle | 307/112 |
| 3,518,586 | 6/1970 | Nilssen | 334/7 |
| 3,699,839 | 10/1972 | Denigan | 84/345 |
| 3,913,442 | 10/1975 | Deutsch | 84/1.19 |
| 3,935,781 | 2/1976 | Katoh | 84/1.11 |
| 3,940,702 | 2/1976 | Yoshimura | 325/464 |

*Primary Examiner*—L. T. Hix
*Assistant Examiner*—S. D. Schreyer
*Attorney, Agent, or Firm*—Klarkquist, Sparkman, Campbell, Leigh & Hall

[57] ABSTRACT

An organ stop switching system includes a plurality of stop switches and a random access memory within which combinations of stop switch settings are stored. The stop switch settings are multiplexed into a memory loop having a capacity fractionally smaller than the random access memory. This loop is used for an input and an output circuit for the random access memory during time slots corresponding to numbered pistons selected for storing and recalling stop setting combinations. A serial-to-parallel converter receives information from the memory loop and provides outputs for operating stop control circuitry of the organ.

13 Claims, 5 Drawing Figures

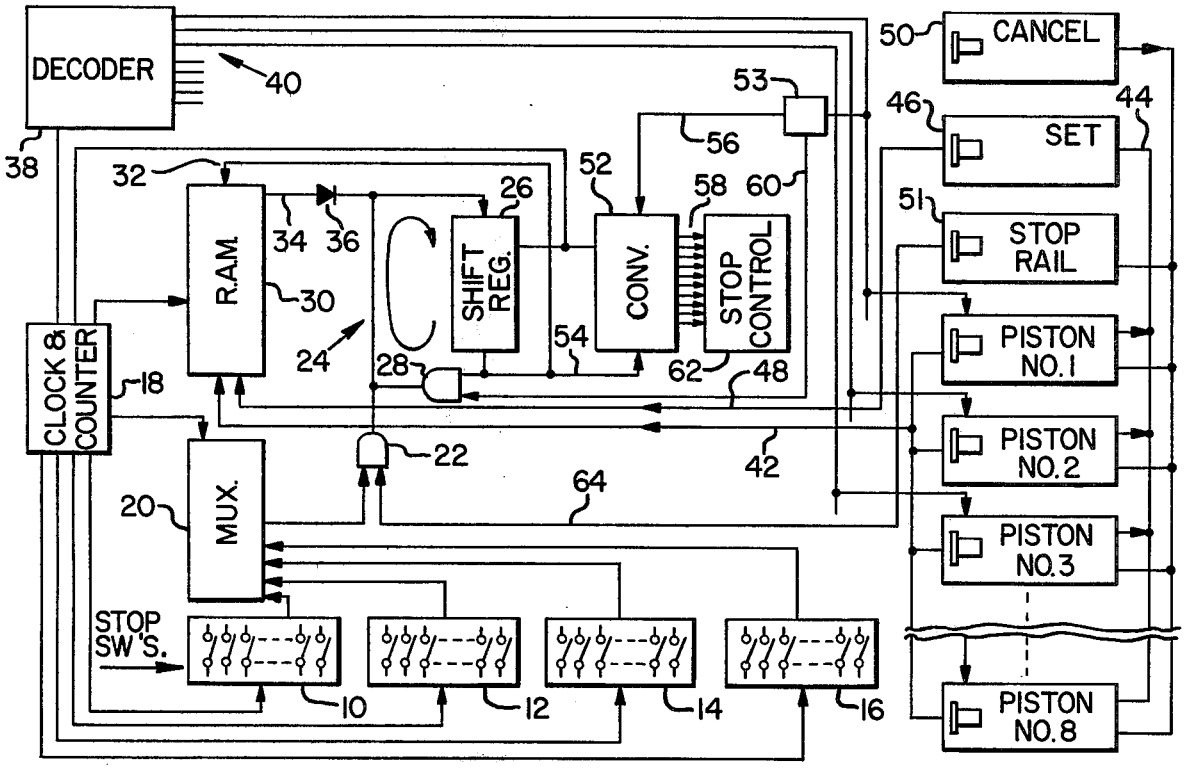
FIG.1
FIG.4
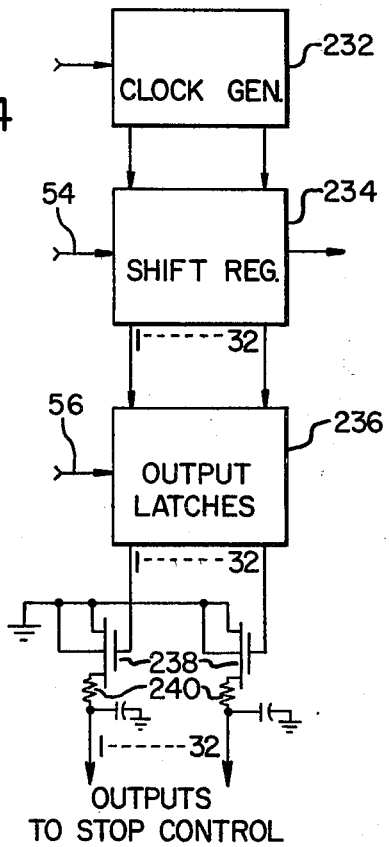
FIG.5
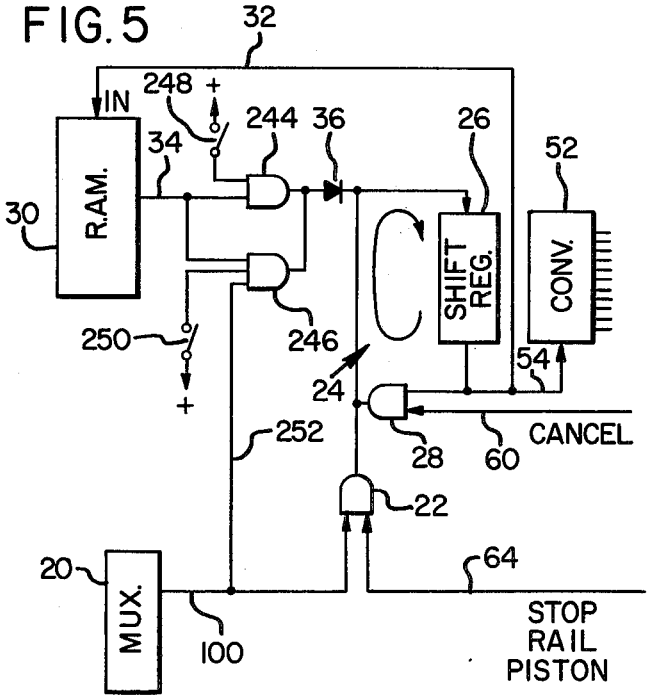

ORGAN STOP SWITCHING SYSTEM

BACKGROUND OF THE INVENTION

The present invention relates to an organ stop switching system, and particularly to a preset system which provides the operator with means for altering or programming the presets while retaining the economy of a preset arrangement.

An organ stop may be defined as a chromatic series of tones of like quality, one tone for each key on the organ keyboard. In practice, a distinction is made between speaking stops (stops which actuate a voice) and nonspeaking stops (couplers, tremulants, echo controls, expression couplers, etc.). Stops are selected by a series of stop switches or stop tabs on the organ console which may be operated by the musician for altering the organ's tonal output, and ordinarily must be manually operated or changed each time a different tonal effect is desired.

Heretofore, combination action systems or combination capture systems have been available for electrically or mechanically storing and recovering memorized stop switch settings whereby the organist may preselect a combination of stop switch settings and later recover the same for organ operation. For recall, the organist selects a combination piston, there being one piston for each memorized or "captured" combination. Combination capture systems are ordinarily quite expensive and involve special stop switches or actuators capable of physical change in position whenever a given piston is actuated so the organist can identify or alter the selected combination. A parallel memory matrix is suitably employed for receiving inputs and providing outputs to the stop switches or actuators. Systems of this type are illustrated in U.S. Pat. No. 3,307,050 issued Feb. 28, 1967 and U.S. Pat. No. 3,497,714 issued Feb. 24, 1970 to Patrick M. Castle.

A much less expensive approach is available in a so-called preset system involving no special stop switches, since the stop switches themselves do not physically move in response to recall of a preset combination. Preset combinations are typically stored in a matrix of isolation diodes wired when the instrument is manufactured. Preset pistons are selectively operated to energize preset buses and deliver current through the isolation diodes to organ tone control circuits, usually in parallel fashion. Piston presets and stop switch settings may be added together at will, i.e. any stop switch or preset piston may empower a given tone control circuit such as a keyer, filter circuit or the like. The presets are "blind" since the stop switches do not move in response to recall, and the combinations cannot be conveniently changed by the user without rewiring the instrument. Of advantage would be an inexpensive preset system having the flexibility of a more expensive combination action.

SUMMARY OF THE INVENTION

A preset system according to the present invention retains the economy of conventional stop presets, while at the same time providing the organist with the ability to preselect presets for later recall. Combinations can also be added to one another, or to stop switch settings as desired.

In accordance with the present invention an organ stop switching system includes a plurality of stop switches and multiplexing means for serially presenting the positions of the stop switches to a loop memory. The loop memory has a capacity fractionally smaller than a system random access memory for which the loop memory acts to provide input and output during successive recirculating periods selected by preset pistons. The output of the loop memory operates stop responsive means after recirculation of the information in the loop memory for several such periods. Programmability of presets is obtained as well as the ability to add presets without requiring complex switching devices or an excessive number of conductors to and from stop switches, thereby retaining the economy and simplicity of a preset system.

It is accordingly an object of the present invention to provide an improved organ stop preset system wherein the organist may preselect or program the stop settings.

It is a further object of the present invention to provide an improved organ stop preset system which is programmable and which is capable of adding preset combinations to one another or to stop switch settings.

It is another object of the present invention to provide an improved organ stop preset system wherein the preset stop settings can be altered by the operator.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a block diagram of an organ stop switching system according to the present invention;

FIG. 4 is a block and schematic diagram illustrating a serial-to-parallel converter utilized in the present invention; and FIG. 5 is a block and schematic diagram of a modification of a portion of the FIG. 1 system for altering stop settings.

DETAILED DESCRIPTION

Figure 2:
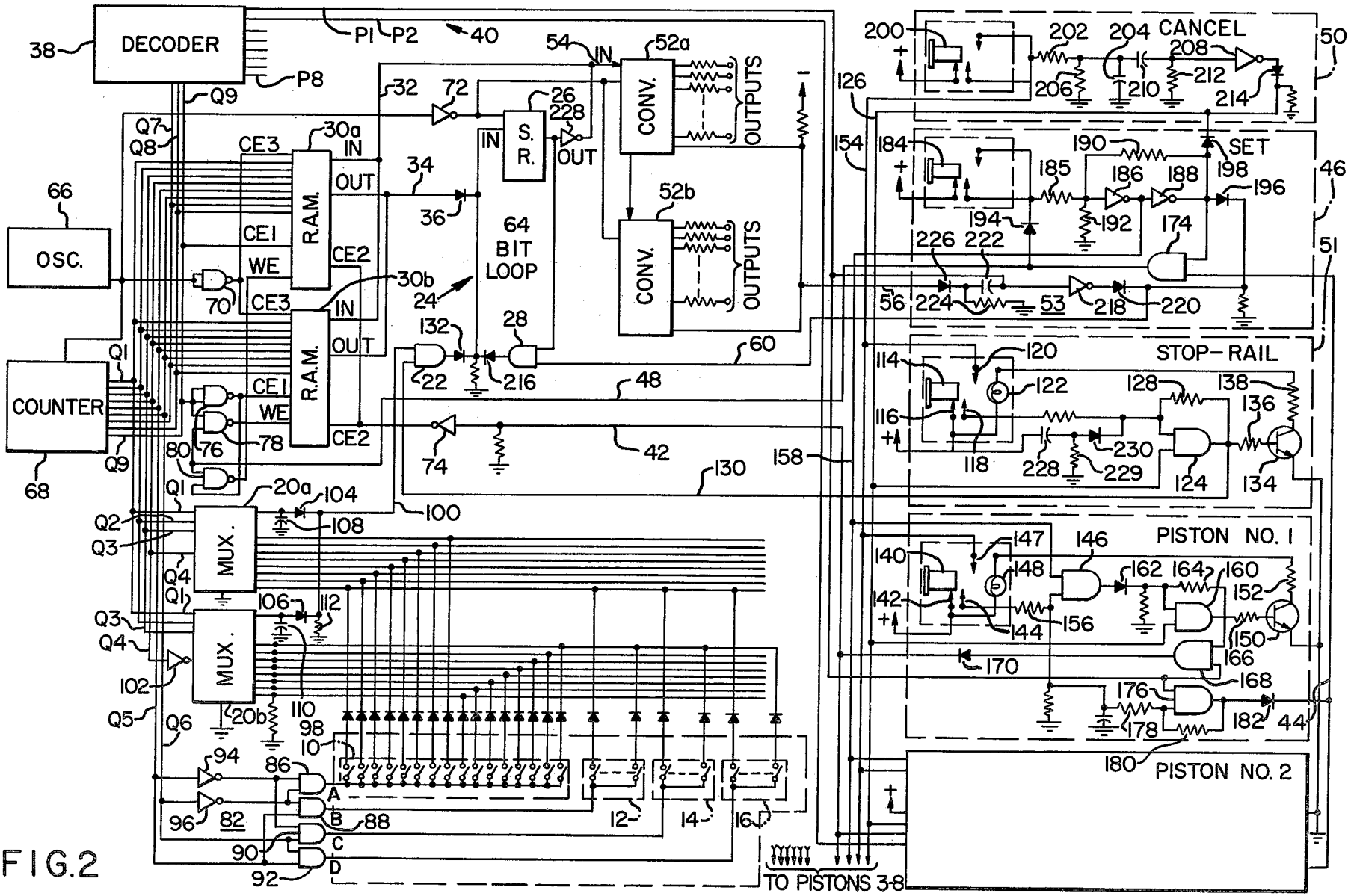
FIG. 2 is a more detailed schematic diagram of the FIG. 1 system.

Referring to the drawings and particularly to FIG. 1, an organ stop switching system according to the present invention includes 64 stop switches conveniently divided into four equal groups numbered 10, 12, 14 and 16 consecutively enabled by clock and counter circuit 18. The stop switches comprise the contacts of manually operable stops or stop tabs on an organ console for selecting various tones or voices, as well as couplers, tremulants, and other organ functions as generally distinct from the keys of the organ manuals. Outputs from stop switch groups 10, 12, 14 and 16, indicative of the operated or nonoperated condition of the individual switches, are converted from parallel to serial order via multiplexer 20. Multiplexer 20 supplies its serial output to AND gate 22 driving loop memory 24 consisting of a shift register 26 having its output coupled back to its input by way of AND gate 28. Thus, the serial information applied to the loop memory recirculates through the shift register.

Shift register 26 operates as an input and output means for random access memory 30, the latter having an input lead 32 for receiving stop switch information in serial form from the loop memory, and an output lead 34 for delivering stop switch information in serial form to the loop memory by way of diode 36. The loop memory 24 has a capacity fractionally smaller than the storage capacity of random access memory 30. In the present embodiment, random access memory 30 has a capacity of 512 bits, while loop memory 24 has a capacity of 64 bits equalling the number of stages in shift register 26 or the number of stop switches in groups 10 through 16. Therefore, eight separate combinations of stop settings can be stored in memory 30. The memory locations in random access memory 30 are successively addressed by clock and counter 18 either for reading or writing purposes, and the loop memory information may be either read into or read out from the random access memory at 64 consecutively addressed bit locations in the random access memory. Consecutively generated clock pulses are counted, and the count is utilized for addressing random access memory 30. Also, information in shift register 26 is shifted by the same clock, while information from the stop switches is multiplexed in time divisions equal to the duration of a clock pulse.

The times at which 64 successive bit locations in random access memory 30 are consecutively addressed are further identified in a decoder 38 which receives the output of clock and counter circuit 18 and generates a plurality of time slot pulses on output leads 40, wherein each such output is 64 bits long, that is having a duration equal to 64 clock pulses from clock and counter 18. These time slot pulses on separate output leads 40 are respectively connected for enabling preset pistons numbered 1 through 8. Only pistons numbered 1, 2, 3 and 8 are shown on the diagram. The pistons include electrical latching circuits so that momentary depression produces a continuous output until canceled. The outputs of the numbered pistons are collected on read control bus 42 which operates random access memory in a read mode to supply addressed information on output lead 34, during a designated time slot. If, for instance, piston No. 1 is operated, bus 42 will be energized during a first, 64 bit time slot. If piston No. 2 is operated, bus 42 will be energized during the next consecutive 64 bit time slot, and so on. Pistons numbered 1 through 8 also supply outputs for a collection bus 44 leading to set piston 46. Piston 46, in turn, operates write bus 48, causing information currently circulating in loop memory 24 to be read into the simultaneously addressed portion of random access memory 30 via its input lead 32. Thus, if piston No. 1 is operated, and set piston 46 is also operated, information from loop memory 24 will be read into random access memory during a first time slot. If piston No. 2 is actuated and set piston 46 is operated at the same time, information in loop memory 24 is stored in a second portion of random access memory 30, etc. The system is further provided with a cancel piston 50 by means of which any of the pistons numbered 1 through 8 may be canceled, that is changed from a latched condition to a non-latched condition.

The output from shift register 26 is also supplied to serial-to-parallel converter 52 via lead 54. Serial-to-parallel converter 52 (further hereinafter described in connection with FIG. 4) continuously receives the output from loop memory 24, but only latches the same after a cycle of eight time slots corresponding to the eight numbered pistons. For this purpose, a circuit 53 receives an input during the piston No. 1 time slot and operates converter 52 through lead 56 for latching the previous information for presentation on output leads 58. At substantially the same time, loop memory 24 is cleared by way of a signal on lead 60 so that a new cycle of operation can begin. Lead 60 normally enables AND gate 28 in the memory loop, but disables the same during the piston No. 1 time slot. As will be recognized, gate 28 is at the output of the shift register 26 and does not prevent information being inserted at the input of the shift register during the piston No. 1 time slot. The outputs 58 from converter 52 are applied to stop control 62 which comprises a plurality of gating circuits for enabling various keyers, amplifiers, filter circuits or the like for actuating or enabling various voices, couplers, tremulanats, etc., of the instrument.

The system is also provided with a stop-rail piston 51 which supplies an output to AND gate 22 on lead 64 for enabling AND gate 22 and passing stop switch information from multiplexer 20 into the memory loop 24, when the stop-rail piston is operated. Thus, the stop switches 10 through 16 are activated only as a consequence of the stop-rail piston being depressed.

Considering overall operation of the FIG. 1 system, the stop switch setting information is entered into loop memory 24 at any time the stop-rail piston 51 is depressed and this information continues to be entered into the loop memory until the stop-rail piston is canceled. If it is desired that this combination of stop switch settings be retained or "captured", one of the pistons numbered 1 through 8 is depressed while set piston 46 is operated whereby the stop switch settings circulating in loop memory 24 are entered into a location in memory 30 corresponding to the time slot associated with the particular numbered piston operated. When retrieval of the same information is desired, one of the numbered pistons is depressed without simultaneous operation of the set piston 46, whereby stop settings corresponding to the numbered piston's time slot are entered from memory 30 into loop memory 24. At the end of a cycle of operation comprising eight time slots, the information from loop memory 24 is latched in serial-to-parallel converter 52 providing its outputs on leads 58, one for each stop setting. Consequently, the same stored information continues to be available at output leads 58 for operating stop control 62 until such time as the selected numbered piston is canceled. If operation according to the manual setting of the stop switches is desired, without retrieval of previously captured combinations, the stop-rail piston 51 is depressed and the loop memory 24 will contain the stop setting at the end of the eight-time-slot cycle of operation.

Any time modification of a captured combination of stop settings for operating the instrument is desired, both the stop-rail piston and numbered piston can be depressed, and as will be seen, information from both random access memory 30 and multiplexer 20 will be entered into loop memory 24. Consequently, stop settings may be added to a captured combination as read through depression of a selected piston. As hereinafter more fully described, it is also possible to withdraw or cancel individual stop settings by a minor modification of the circuitry. Of course, an altered combination of stops, as may be pleasing to the musician, can be reentered into random access memory 30, either in the same piston location or in another piston location through operation of the appropriate numbered piston and the set piston 46.

Moreover, the stop setting associated with more than one memory location can be combined simply by depression of more than one numbered piston. Then the desired stop settings are read into loop memory 24 during different recirculating periods of the loop memory, and the information is in effect added. The additive combination is latched by serial-to-parallel converter 52 at the end of an eight-time-slot cycle of operation.

Figure 3:
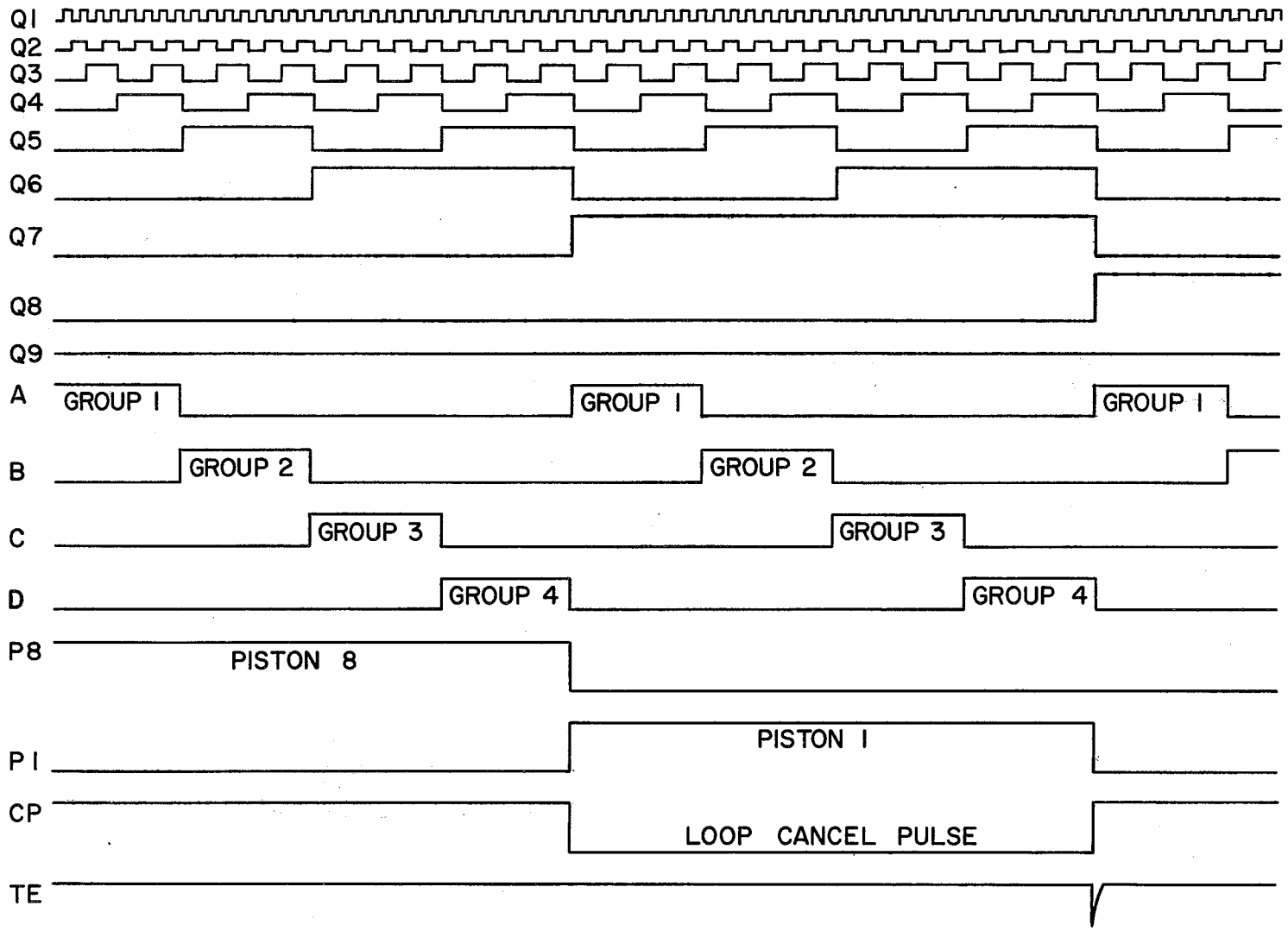
FIG. 3 is a waveform chart illustrating operation of the system according to the present invention.

Now considering the system in greater detail, reference is made to the schematic diagram of FIG. 2 and the waveform chart of FIG. 3. The basic timing of the circuit is controlled by clock oscillator 66 providing a square wave, 100 kHz. output to counter 68, random access memory 30*a*, 30*b* via inverter 70, and shift register 26, as well as serial-to-parallel converter 52*a*, 52*b* via inverter 72. The oscillator 66 and counter 68 together comprise the clock and counter circuit 18 as shown in FIG. 1. The counter 68 counts the 100 kHz. clock pulse and provides a binary output on nine output leads Q1 through Q9, equivalent to a decimal count of 512, for addressing binary bit storage locations in random access memory 30*a*, 30*b*. The counter 68 continuously counts and repeatedly cycles through the binary addresses on leads Q1 through Q9 which are coupled for addressing random access memory contents.

The random access memory comprises two National Semiconductor MM74C200 random access memories or RAMS in integrated circuit form. Each of the two units, 30*a* and 30*b*, is a tri-state CMOS device with a capacity of 256 bits of information. The output of each device on the lead labeled OUT can assume any of three states, i.e., high, low, or high impedance. Each of the two devices essentially receives eight input address lines, Q1 through Q8. Note that $2^8=256$, which is equal to the number of bits of capacity for each memory chip. Since 512 bits of information are required, the Q9 output from the counter is employed to enable only one memory chip at a time. Each memory chip has three chip enable inputs, CE1, CE2 and CE3, as well as a write enable input, WE. CE1 and CE2 affect only the read operation, while CE3 and WE affect both read and write. Data is read out or written in on the positive-to-negative transition of CE3 which is connected to the clock oscillator 66 via inverter 70.

Data is read out of the random access memory by selecting the proper address on leads Q1 through Q8 and bringing CE3 low while holding WE high. During a numbered piston's time slot, a time slot signal will be present on lead 42 which is inverted by inverter 74 and applied to the CE2 terminals. When CE2 is high, the outputs of the memory chips will be in the tri-state condition and no data will be read out. However, when CE2 is brought low by the presence of a time slot signal, the memory chips will be permitted to read out data. The Q9 output of counter 68 is connected directly to chip enable input CE1 of memory unit 30*a*, and through an inverter 76 to chip enable input CE1 of memory unit 30*b*. This will force one of the two memory chips into the tri-state condition, thereby consecutively selecting the output from the remaining memory unit. As stated, read out actually occurs upon the positive-to-negative transition of the inverted clock signal output from inverter 70 as applied to the CE3 chip enable input. One cycle of the clock signal represents one bit of information.

It will be seen that during the piston No. 1 time slot, memory bits one through 64 are individually addressed in sequential order. They will be read out onto lead 34 assuming piston No. 1 is actuated. During the piston No. 2 time slot, bits 65 through 128 will be read out from the memory if piston No. 2 is actuated. For piston No. 3, bits 129 through 192 would be read out, and so on, in groups of 64 bits.

For the memory write operation, the chip enable CE3 requirements are the same as for the read operation. Chip enable inputs CE1 and CE2 have no effect on the write operation, and therefore address operation via the Q9 counter output, and the numbered piston time slot gating, must be accomplished using the write enable or WE inputs. The WE input of a memory chip must be at a logical low level in order to write in new data. Assuming the set piston 46 is depressed, and one of the numbered pistons is depressed, a time slot pulse will appear on lead 48 corresponding to the time slot associated with the selected numbered piston. The Q9 counter output is connected directly to NAND gate 78, and through inverter 76 to NAND gate 80, with both NAND gates 78 and 80 receiving lead 48 as an input. Hence, the selected piston time slot signal will be inverted and appear at the write enable or WE input of the correct memory chip, 30*a* or 30*b*, for writing. This will allow the memory chip to write-in or store new data during the time slot in question. The input to be written is received via lead 32 from the loop memory 24.

Stop-rail multiplexers 20*a* and 20*b* convert the information from the stop switches from parallel to serial form. This is done in conjunction with a one-of-four stop group decoder 82 including four AND gates 86, 88, 90 and 92 producing outputs respectively designated A, B, C, and D. An inverter 94 is coupled between the Q5 output of a counter 68 and first inputs of AND gates 86 and 90, while a second inverter 92 is interposed between counter output Q6 and a first input of AND gate 88 as well as a second input of AND gate 86. Furthermore, the Q5 counter output is connected to second inputs of AND gates 88 and 92. Counter output Q6 is further coupled as a first input to AND gate 92 and a second input of AND gate 90. The decoder 82 provides outputs A, B, C and D, which are each consecutively energized for sixteen clock pulses and consecutively provide power to one of the groups of stop switches 10, 12, 14 and 16, respectively. The decoder 82 is seen to be a two-binary-bit to four-line converter.

It is understood each of the groups of stop switches, 10, 12, 14 and 16 include sixteen stop switches, but only the switches of group 10 arc all shown in the drawing. During the output A from AND gate 86, the switches of group 10 are energized for the period of sixteen clock pulses, and selected of sixteen possible outputs from the sixteen stop switches of group 10 are coupled through isolation diodes 98 to the inputs of multiplexers 20*a* and 20*b*, in accordance with the particular stop switches which have been actually operated or closed. Multiplexers 20*a* and 20*b* receive counter outputs Q1, Q2, Q3 and Q4, and operate as a line selector for consecutively providing the conditions of the stop switches of group 10 in serial fashion on output lead 100. Since $2^4=16$, the multiplexers 20*a* and 20*b* serially select each one of the inputs on the sixteen individual input lines, and supply the same as an output on line 100. Q1, Q2 and Q3 are applied to both the multiplexers, but Q4 is applied in non-inverted form to multiplexer 20*a*, but in inverted form to multiplexer 20b via inverter 102 such that multiplexer 20b operates in inverse fashion from multiplexer 20a. The outputs to line 100 aree summed and filtered by diodes 104, 106, capacitors 108, 110 and resistor 112. Each of the multiplexers 20a and 20b receives eight of the input lines. After 16 clock pulses, switch group 12 will be energized instead of group 10, and its sixteen outputs will be supplied on line 100. Since Q5 and Q6 are applied to decoder 82 and since $2^6=64$, it can be seen the system is effective to scan the sixty-four stop switches including groups 10, 12, 14 and 16 successively.

Counter outputs Q7, Q8 and Q9 are applied to decoder 38 which operates in a manner well known to those skilled in the art and substantially similar to the operation of decoder 82 to supply consecutive outputs P1 through P8 on respective output leads 40 of the decoder. The outputs P1 through P8 comprise the time slot pulses, each 64 bits long, for respectively numbered pistons 1 through 8 and are correspondingly connected in energizing relation to such pistons.

The relationship between timing pulses and the outputs of counter 68 are illustrated in FIG. 3 wave-form chart. It is seen the waveforms Q1 through Q9 are successive binary counting pulses for a segment of the operation cycle of the present system. The pulse Q9 does not appear on this diagram but is understood to occur at a later time in the complete cycle of operation. The decoder 82 outputs A, B, C and D which energize the respective groups of stop switches are further identified on the diagram by the designations: Group 1, Group 2, Group 3 and Group 4. The time slot pulses P1 and P8 for pistons 1 and 8 are also illustrated. It will be seen that the time slot for a given piston corresponds to sixty-four stop switch positions as subdivided into four groups: Group 1, Group 2, Group 3 and Group 4 according to the operation of decoder 82. It will be appreciated further time slot pulses for the remaining pistons are consecutively generated but are omitted from the waveform chart to preserve clarity of the presentation. The end of the piston 8 time slot pulse, P8, corresponds to the end of a cycle of operation for the system, with the time slot pulse P1 beginning the next cycle of operation. The loop cancel pulse, CP, is delivered on line 60 from circuit 53 and is seen to be the inverse of the piston 1 time slot pulse P1. A transfer enable pulse, TE, as presented on line 56, occurs at the end of the loop cancel pulse for latching information at the outputs of serial-to-parallel converter 52a, 52b.

Referring again to FIG. 2, stop-rail piston 51 includes push button 114 of the double touch type, i.e., if the piston button is depressed to a first point of physical resistance, contact 116 connected to a source of positive voltage will make connection with contact 118. Further pressure on the piston button will cause it to be depressed to a second stopping point at which time connection will be made between contacts 116, 118 and 120. Included as a part of the piston is an incandescent lamp serving as an indicator that the piston is in the latched condition. In general, the other pistons include similar push button arrangements, but only the stop-rail piston and the numbered pistons make use of the double touch feature, the latching feature and the latch indicating lamp.

Contact 118 in the stop-rail piston is coupled as one input to AND gate 124 having a remaining input connected to cancel bus 126 which is normally held at a logical high level. AND gate 124 is provided with a feedback resistor 128 connected between its output and the first mentioned input for holding the AND gate in a latched-on condition until such time as cancel but 126 goes low. The output of stop-rail AND gate 124 is supplied to AND gate 22 on lead 130 for enabling the AND gate to couple the multiplexer output on lead 100 into the loop memory 24 via diode 132. The output of AND gate 124 is also connected to the base of transistor 134 through resistor 136, while resistor 138 connects the transistor's collector in energizing relationship to lamp 122. The incandescent lamp 122 will remain illuminated so long as the piston remains latched and AND gate 22 is enabled to provide the output from multiplexer 20a, 20b to the loop memory.

Thus, when the stop-rail push button is depressed to the point of first resistance, the stop-rail piston will become latched and the stop switch positions will be coupled into the loop memory 24. Consequently, the organ will substantially immediately respond to produce the tonal values selected when one or more organ keys are depressed. The latching circuit will act to hold this condition until canceled. If the push button 114 is depressed to a second stopping point, contact 120 will be energized for operating the cancel piston circuit via lead 154 for canceling the action of any other pistons which may have been in the latched condition. When the cancel pulse has passed (after approximately 50 milliseconds) the stop-rail piston button which is still being depressed will now cause relatching of the stop-rail piston circuit to the on position while other pistons will remain off. Differentiating circuit 228,229, 230 energizes the stop-rail piston when the organ is initially turned on.

Piston No. 1 includes a push button 140 having contacts 142, 144 and 147 as well as an incandescent lamp 148 energized by transistor 150 via resistor 152. Depressing button 140 to the point of first physical resistance energizes contact 144 supplying an input to AND gate 146 through resistor 156. The second input for AND gate 146 is provided from non-set bus 158 which is high so long as the set piston is not depressed. Consequently, AND gate 146 will energize AND gate 160 through isolation diode 162, with the remaining, normally high input of AND gate 160 being received from cancel bus 126. Feedback resistor 164 maintains the AND gate in a latched-on condition until canceled. The output of AND gate 160 is supplied to the base of transistor 150 through resistor 166 for maintaining lamp 148 in an on condition as long as piston No. 1 remains latched. The output of AND gate 160 is further supplied to AND gate 168 which receives time slot pulse P1 as its remaining input. Consequently, AND gate 168 energizes lead 42 through diode 170 and brings about reading of random access memory 30a, 30b, into the loop memory during the piston No. 1 time slot. So long as piston No. 1 remains actuated or latched, the stop switch positions stored by bits 1 through 64 in random access memory 30a, 30b will be read into loop memory 24, and will then be latched by serial-to-parallel converter 52a, 52b at the end of each eight time slot cycles.

If piston No. 1 button 140 is depressed all the way, contact 146 is energized for causing cancellation of the latched-on condition of other pistons. Therefore, when the numbered piston is depressed to the point of first resistance, the stop switch settings represented thereby will be added to settings that may have been selected by other latched-on pistons via loop memory 24. However, if the button 140 is depressed to a second and further position, other piston settings will be canceled, and only the stop switch positions represented by piston No. 1 will be inputted to the loop memory and latched in serial-to-parallel converter 52*a*, 52*b*. When the cancel pulse has passed, the No. 1 piston will remain latched.

Each numbered piston serves two primary purposes. The first is the reading of the random access memory into the loop memory during a given time spot represented by the piston. The second is the selection of data for entry into random access memory 30*a*, 30*b* during a given time slot represented by the piston, thereby "reprogramming" the piston. When the numbered piston, for example piston No. 1, is held in the depressed position, it is used for the set or write function. It should be pointed out that the write or set function will not cause the latch portion of the piston circuits to be affected in any way. I.e., if the latch circuit is on prior to the write or set operation, it will remain on. If it was not latched on prior to the write or set operation, it will not be latched on afterwards.

When a particular piston is to be reprogrammed, such as piston No. 1, the piston is operated and held down at the same time that set piston 46 is operated. Actuation of the set piston removes the enabling input to gage 146 on lead 158, and also supplies a circuit path via collective bus 44 and AND gate 174 to write bus 48. Contact 144 energizes AND gate 176 through resistors 156 and 178, causing AND gate 176 to latch-on through feedback resistor 180 during the time slot pulse P1 provided as the second input of AND gate 176. The output of AND gate 176 is coupled to bus 44 through diode 182.

Thus, to program a numbered piston a plurality of stop switches in groups 10, 12, 14 and 16 are set in the desired manner and their positions are entered into loop memory 24 by actuation of the stop-rail piston. Then, while holding the set piston 46 depressed, the piston to be programmed is also depressed, e.g., piston No. 1 AND gate 176 is thereby turned on, placing a high on collective bus 44 which in turn energizes write bus 48 by way of AND gate 174.

The circuits for the remaining numbered pistons, 2 through 8, are substantially identical to that described for piston No. 1 with the major exception of the decoder output 40 connected thereto. Thus, piston No. 2 receives time slot pulse P2 on its gates 168 and 176, while piston No. 3 similarly receives time slot pulse P3, and so on.

Further considering set piston 46, this piston circuit includes a push button 184 for coupling a positive voltage through resistor 185 to a Schmitt trigger circuit comprising cascaded inverters 186 and 188 shunted by feedback resistor 190. Resistor 192 normally holds the input of the Schmitt trigger circuit referenced to ground and consequently the output of inverter 186 on line 158 will normally be high for energizing AND gate 146 in each of the numbered pistons. When push button 184 is depressed, the output of inverter 186 on line 158 goes low, thus disconnecting the latch portion of each numbered piston circuit from the push button. The push buttons on the numbered pistons can now be used in the writing process without disturbing the latch portion of a piston circuit. While holding the set piston push button depressed, one of the pistons numbered 1 through 8 can be depressed for writing information from loop memory 24 into random access memory 30*a*, 30*b* as hereinbefore described. The time slot signal for the selected numbered piston will also connect back to the input of the set piston circuit through diode 194. This serves to hold the set piston circuit on until the end of the time slot pulse, even though the set piston push button may have been released. When the Schmitt trigger circuit is operated, the output of inverter 188 is coupled for enabling AND gate 174 for the writing process as hereinbefore described. The inverter 188 output is further coupled to circuit 53 through diode 196, and to the cancel piston 50 output through diode 198.

Considering the cancel piston 50, a push button 200 is employed to apply a positive voltage to a pulse forming circuit through resistor 202, said pulse forming circuit comprising capacitor 204 and resistor 206 shunted in parallel to ground and coupled to the input of inverter 208 via capacitor 210, wherein the inverter input is returned to ground through resistor 212. Depression of the push button produces a negative going pulse of approximately 50 milliseconds at the output of inverter 208. The output of inverter 208 is normally high, as hereinbefore mentioned, and this positive voltage is coupled to cancel bus 126 through diode 214. However, when the aforementioned 50 millisecond cancel pulse occurs, the line 126 drops to ground, thereby de-energizing the latching dircuits including AND gate 124 in the stop-rail piston and AND gate 160 in the numbered pistons. Consequently, the last mentioned pistons are canceled. The diode 198 from the set piston circuit prevents cancellation from occurring during setting. It is noted the cancel piston circuit may be actuated by an input on line 154 whenever the stop-rail piston or one of the numbered pistons is fully depressed.

The heart of the preset system is the sixty-four bit loop memory 24, principally including shift register 26 have sixty-four stages. The output of shift register 26 is connected to the input of AND gate 28, the output of which is coupled right back to the input of the shift register 26 through diode 216. Therefore, data coming out of the shift register will be coupled right back into the shift register's input, and data will continue to circulate until the loop is opened at AND gate 28. The loop is opened by loop cancel pulse, CP derived from circuit 53, shown in FIG. 2 as part of the set piston circuit. As hereinbefore mentioned, the loop cancel pulse is the inverse of the piston 1 time slot pulse, P1, and is derived from the P1 output of decoder 38 through inverter 218 in circuit 53 coupled to AND gate 28 by way of diode 220 and line 60. Diode 196 from the set piston output is coupled to the same line for preventing loop cancellation during setting. The piston 1 time slot pulse P1 at the input of inverter 218 is also coupled to a differentiating circuit comprising capacitor 222 having its output shunted to ground by resistor 224 for delivering a negative going spike through diode 226 at the end of the piston 1 time slot pulse. This spike comprises the transfer enable pulse TE delivered to serial-to-parallel converter 52*a*, 52*b* on line 56. Thus, the sixty-four bit loop is opened at the end of each cycle of the system comprising eight piston time slots, while at the end of the piston 1 time slot, the pulse TE is generated for transferring information to the latches of converter 52*a*, 52*b*.

The output of the shift register 26 is applied to the input lead 54 of serial-to-parallel converter 52*a*, 52*b*, as well as to random access memory input lead 32, through inverter 228. It will be appreciated that at the end of the piston 1 time slot, the data from the piston 8 time slot and the summed data from all the previous time slots will reside in serial-to-parallel converter 52*a*, 52*b*, even though the same information has been deleted from the sixty-four bit memory loop by means of the loop cancel pulse, CP.

As hereinbefore indicated, information may be entered into the memory loop from random access memory 30*a*, 30*b* via diode 36 during any time slot selected by a corresponding piston. Also positions of the stop switches may be entered via multiplexer 20*a*, 20*b* through AND gate 22 at any time the stop-rail piston is actuated. Information in the loop may be written into the random access memory 30*a*, 30*b* via lead 32 whenever the set piston and a numbered piston is actuated. Furthermore, information from the loop is coupled into the serial-to-parallel converter 52*a*, 52*b* and is latched therein for output at the end of each cycle of eight time slot pulses. As an example of operation, suppose a piston No. 3 and a piston No. 5 are depressed. Once depressed, these pistons will latch on, and the random access memory 30*a*, 30*b* will now read out serial data into the loop during time slots 3 and 5 respectively. During all other time slots, the memory output will remain in a high impedance (non-reading) condition. During the time slot for piston No. 3, serial data will be clocked into the shift register 26. During the time slot for piston No. 4, no data will come from the random access memory. However, the data that was just clocked into the shift register will come out of the shift register and re-enter the shift register in synchronization with the No. 4 time slot. During the time slot for piston No. 5, serial data will again come from the memory 30*a*, 30*b* and be clocked into the shift register 26. Simultaneously, data coming out of the shift register will be adding to the data from the memory 30*a*, 30*b*, the result being the addition of the piston 3 data and the piston 5 data. The data will continue to circulate around the memory loop until the end of the time slot for piston No. 8. During the immediately following piston 1 time slot, the loop is opened at AND gate 28 and the combined data will not be permitted to re-enter the shift register. However, the combined data is read into and latched for output from serial-to-parallel converter 52*a*, 52*b*. The memory loop is thus employed to add and temporarily store digital data. It should again be pointed out that data from multiplexer 20*a*, 20*b* can enter the loop 24 at any time the stop-rail piston is latched on. This system represents a very convenient and economical way for handling a sizeable amount of data for organ stop positions on an economical basis without the requirement of a rather considerable amount of computer type logic and multiple conductors for writing, reading and combining data as stored in digital memory. Moreover, it is seen the data from the multiplexer 20*a*, 20*b* to the loop, and from the loop to the output converter 52*a*, 52*b* is serialized, making physical placement of the various units quite flexible.

Serial-to-parallel converter 52 suitably comprises two National Semiconductor MM5559 integrated circuits, one of which is illustrated in FIG. 4. The circuit includes a clock generator 232 driven from clock oscillator 66 via inverter 72 (in FIG. 2) and adapted to provide a two-phase clock for operating shift register 234. Shift register 234 receives an input on lead 54, in the case of converter circuit 52*a*, and provides a serial output at the end of the serial shift register for supplying an input to converter circuit 52*b*. Thirty-two of the shift register stages provide parallel outputs 1–32 to output latches 236 which are operated by a transfer enable signal on lead 56 for latching the states of the thirty-two shift register stages. Thus, each time a transfer enable pulse is received, the output latches are re-operated, and store the shift register states until another transfer enable pulse is received. Output buffers comprising field effect transistors 238 receive the thirty-two outputs of latches 236 on their respective gate terminals, while the drain terminals thereof are coupled to provide outputs through resistors 240. These outputs then control various filters, keyers, or other stop responsive means, by which the organ tone is continuously controlled. Stop responsive means can also include indicating lamps (not shown) to indicate operated stop settings. Such lamps can be located adjacent switches 10, 12, 14 and 16 if so desired.

Referring to FIG. 5, a modified circuit is illustrated for altering stop settings in a subtractive sense. This circuit is shown in the same block diagram form as FIG. 1 and may be added thereto to provide the further function. In particular, a pair of AND gates 244 and 246 are inserted between the output lead 34 of random access memory 30 and diode 36 leading to the loop memory 24. AND gate 244 receives memory output 34 as a first input thereof, and a positive voltage via switch 248 as a second input thereof. If switch 248 is closed, then the circuit will operate in substantially the same manner as hereinbefore described with respect to FIGS. 1 and 2. Thus, information may be entered into the loop memory from the stop switches by way of multiplexer 20, and/or information from memory 30 can be entered into the loop memory in accordance with the operation of one or more pistons. Since the process is additive, preset stop settings can be altered in the sense of adding other stop settings thereto, either from the stop switches or from a separate preset combination identified by another piston.

The circuit of FIG. 5 provides means for subtracting a stop setting from a preset combination. The second AND gate 246 receives a first input from memory output 34, a second input from a positive voltage via switch 250 and a third input on lead 252 from the multiplexer 20 output. When it is desired to operate the circuit in a subtractive sense, switch 248 is opened while switch 250 is closed, thereby enabling AND gate 246 instead of AND gate 244. Let us assume all of the stop switches in groups 10, 12, 14 and 16 are operated to the closed circuit condition. One of the numbered pistons is then operated to select a corresponding preset combination from random access memory 30 for entry into loop memory 24. Since the output of multiplexer 20 and the output of memory 30 are then "ANDed", and since all of the stop switches are actuated, the preset combination will be entered into the loop memory as before. However, should any of the stop switches be opened, the contents of memory 34 entered into the loop memory on the next cycle of operation will have bits deleted therefrom in accordance with whatever stop switches have been opened. Therefore, the organist can substract stop settings at will from the preset combination. Although the FIG. 5 circuit has been described for a mode of operation wherein all the stops are actuated other than for stops to be deleted, it is apparent a simple inversion of the signal in lead 252 will secure the reverse mode of operation, i.e., wherein closure of normally open stop switches may be used for deleting a stop from a preset combination.

While I have shown and described preferred embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. An organ stop switching system comprising:

a plurality of manually operable stop elements and means for electrically registering the positions of said stop elements in serial order, a first memory for storing plural different combinations of stop elements at different memory locations and means for cyclically accessing said locations in said first memory, a second memory and means for cyclically accessing locations in said second memory wherein the capacity and operating cycle of said second memory are less than said first memory for storing a combination of stop element positions, means for selectively coupling the positions of said stop elements to said second memory, a plurality of combination selection pistons and means responsive thereto for coupling said first memory to said second memory during the cycle of said second memory corresponding to a portion of the cycle of said first memory for entering combinations into said first memory so that different selected combinations from said first memory are transferable into said second memory in additive relation, and means for receiving the output of said second memory for operating stop responsive means.

2. An organ stop switching system comprising:

a plurality of stop switches and multiplexing means for representing the positions of said stop switches in serial order, a first memory and means for sequentially accessing locations in said first memory, a loop memory for recirculating information provided thereto and having a capacity smaller than said first memory, means for selectively coupling the output of said multiplexing means to said loop memory, a plurality of selection pistons and means responsive thereto for selectively coupling the output of said first memory to said loop memory during selected recirculating periods thereof and in additive relation to information as may be circulating in said loop memory, and stop control means and means for receiving the output of said loop memory for operating said stop control means after recirculation of information in said loop memory.

3. The system according to claim 2 further including means for selectively coupling the output of said loop memory for writing information into said first memory during selected recirculating periods of said loop memory.

4. The system according to claim 2 including means for selectively combining the output of said multiplexing means and the output of said first memory as coupled to said loop memory.

5. The system according to claim 4 wherein the output of said multiplexing means and said first memory are ANDed for selectively substracting information from a combination stored in said first memory as coupled to said loop memory.

6. The system according to claim 2 wherein information is recirculated in said loop memory for a predetermined number of successive recirculating periods at least equal to the number of respective selection pistons, and wherein said means for receiving the output of said loop memory is operated at the end of a cycle equal to said predetermined number of recirculating periods.

7. The system according to claim 6, including means for clearing said loop memory after each cycle of system operation.

8. The system according to claim 2 wherein the capacity of said loop memory is fractionally smaller than the total accessed locations in said first memory, and including means for cyclically addressing successive portions of said first memory, any one of which can be coupled for substantially filling said loop memory during a recirculating period thereof.

9. A stop switching system for an organ comprising:

a plurality of stop switches, a circulating loop memory for storing a combination of stop switch positions for said organ in serial order, a random access memory having a capacity for storing several combinations of stop switch positions each comprising a different selection of stop switch positions for said organ, means for accessing combinations of stop switch positions from said random access memory during consecutive time slots, including piston means effective during consecutive time slots for coupling different combinations of switch positions from the random access memory to the same circulating loop memory in a selectively additive manner when more than one piston means is selected, and stop control means and means for receiving the output of said loop memory for operating said stop control means after recirculation of information pertaining to stop positions in said loop memory.

10. A stop switching system for an organ comprising:

a plurality of stop switches and multiplexing means for representing the positions of said stop switches in serial order, a circulating loop memory for receiving stop switch information from said multiplexing means and storing a combination of stop switch positions in serial order, a random access memory having a capacity for storing several combinations of stop switch positions, each combination comprising a different selection of stop switch positions for said organ, timing means for generating a plurality of time slots each corresponding to a period of recirculation of information in said circulating loop memory, and including means for successively addressing different combinations of stop switch positions in said random access memory during successive time slots, a plurality of combination selection pistons and means responsive thereto for coupling said random access memory to said loop memory during time slots selected by said pistons, wherein each piston enables coupling during a different time slot so that a different combination of stop switch positions is entered into said loop memory during each time slot, according to the selection pistons that are actuated, for selectively adding stop switch position information in said loop memory, and means for receiving the output of said loop memory for operating stop responsive means.

11. The system according to claim 10 including means for selectively combining the output of said multiplexing means and the output of said random access memory as coupled to said loop memory.

12. The system according to claim 10 including means for coupling said loop memory to said random access memory during time slots selected by said selection pistons for writing stop positions combinations into selected portions of said random access memory.

13. The system according to claim 12 wherein said means for coupling comprises a set piston operable in combination with a said selection piston.

* * * * *